US009825370B2

(12) United States Patent
Liu et al.

(10) Patent No.: US 9,825,370 B2
(45) Date of Patent: Nov. 21, 2017

(54) ANTENNA REFLECTOR PHASE CORRECTION FILM AND REFLECTOR ANTENNA

(71) Applicant: Kuang-Chi Innovative Technology Ltd., ShenZhen (CN)

(72) Inventors: Ruopeng Liu, ShenZhen (CN); Chunlin Ji, ShenZhen (CN); Yutao Yue, ShenZhen (CN); Yuqing Liu, ShenZhen (CN)

(73) Assignee: KUANG-CHI INNOVATIVE TECHNOLOGY LTD., Shenzhen (CN)

( * ) Notice: Subject to any disclaimer, the term of this patent is extended or adjusted under 35 U.S.C. 154(b) by 156 days.

(21) Appl. No.: 14/588,375

(22) Filed: Dec. 31, 2014

(65) Prior Publication Data

US 2015/0155635 A1 Jun. 4, 2015

Related U.S. Application Data

(63) Continuation of application No. PCT/CN2013/078758, filed on Jul. 3, 2013.

(30) Foreign Application Priority Data

Jul. 3, 2012 (CN) ..... 2012 1 0226480

(51) Int. Cl.
*H01Q 15/14* (2006.01)
*H01Q 15/00* (2006.01)
(Continued)

(52) U.S. Cl.
CPC ..... *H01Q 15/148* (2013.01); *H01Q 15/0053* (2013.01); *H01Q 15/145* (2013.01); *H01Q 15/16* (2013.01); *H01Q 19/12* (2013.01)

(58) Field of Classification Search
CPC ..... H01Q 15/02; H01Q 19/065
(Continued)

(56) References Cited

U.S. PATENT DOCUMENTS 3,922,682 A 11/1975 Hyde
4,754,286 A * 6/1988 Brunner ..... H01Q 25/02 343/770
(Continued)

FOREIGN PATENT DOCUMENTS

CN 102479988 A 5/2012
CN 102480030 A 5/2012
(Continued)

*Primary Examiner* — Hoang V Nguyen
*Assistant Examiner* — Jae Kim
(74) *Attorney, Agent, or Firm* — Perkins Coie LLP

(57) ABSTRACT

The disclosure relates to an antenna reflector phase correction film and a reflector antenna. The antenna reflector phase correction film includes a first substrate, a second substrate, and multiple artificial microstructures disposed between the first substrate and the second substrate, the artificial microstructures are wires made of electrically conductive materials, and an electromagnetic wave, emergent after being reflected by an antenna reflector attached with the antenna reflector phase correction film, has an equiphase surface. According to the disclosure, the antenna reflector phase correction film has specific refractive index distribution internally, so that a surface emergent phase of a reflector can be corrected after attaching onto a surface of a conventional reflector, a phase error caused due to installation or processing is improved, a complete flat emergent equiphase is obtained, and then a far-field performance (such as a higher gain) is improved.

18 Claims, 8 Drawing Sheets

(51) Int. Cl.
*H01Q 15/16* (2006.01)
*H01Q 19/12* (2006.01)

(58) Field of Classification Search
USPC ..... 343/753, 909, 757, 761, 782; 793/339.05, 482.1, 503.1; 359/642, 620, 359/321, 341.32, 586, 652
See application file for complete search history.

(56) References Cited

U.S. PATENT DOCUMENTS

| | | | | |
|---|---|---|---|---|
| 6,181,289 | B1 | 1/2001 | Matsui | |
| 6,512,495 | B1 | 1/2003 | Ragland | |
| 2003/0112184 | A1 | 6/2003 | Jenabi | |
| 2007/0287634 | A1 | 12/2007 | Lin et al. | |
| 2010/0066639 | A1* | 3/2010 | Ngyuen | H01Q 19/062 343/911 R |
| 2010/0232017 | A1* | 9/2010 | McCarthy | B82Y 20/00 359/485.05 |
| 2010/0271692 | A1 | 10/2010 | Hor et al. | |

FOREIGN PATENT DOCUMENTS

| | | | |
|---|---|---|---|
| CN | 102480056 | A | 5/2012 |
| CN | 202231153 | U | 5/2012 |
| CN | 102820544 | A | 12/2012 |
| EP | 0055324 | A2 | 7/1982 |
| EP | 0270294 | A2 | 6/1988 |

* cited by examiner

ANTENNA REFLECTOR PHASE CORRECTION FILM AND REFLECTOR ANTENNA

CROSS REFERENCE TO RELATED APPLICATIONS

This application is a continuation of PCT/CN2013/078758 filed on Jul. 3, 2013, which claims priority to CN 201210226480.4 filed on Jul. 3, 2012, both of which are incorporated by reference.

TECHNICAL FIELD

The disclosure relates to the metamaterial field, and more specifically, to an antenna reflector phase correction film and a reflector antenna.

BACKGROUND

A parabolic reflector antenna is an important part of electrical devices such as a radar and communications, and surface accuracy of an antenna reflector is a main factor that affects electrical performance such as antenna gain. Currently, along with an increase in antenna aperture and working frequency, increasingly high requirements are imposed on accuracy of an antenna reflector. A reflector of a large parabolic antenna usually consists of dozens or even hundreds of reflectors that are assembled; therefore, installation adjustment level of an antenna panel is one of main factors that affect accuracy of an antenna reflector. Traditionally, an assembler adjusts a position of an antenna panel by experience according to actually measured data of the panel. In this way, upon installing and positioning an antenna panel, multiple times of adjustment is required, with low efficiency and accuracy. Especially, when there are relatively many antenna panels and there are high requirements on accuracy, the foregoing issue becomes more prominent.

In addition, design of a parabolic reflector is generally based on an ideal paraboloid, and if a feed source is not a point source, a phase error will also be caused on a surface where an electromagnetic wave is emergent.

SUMMARY

A technical problem to be solved by the disclosure is, aiming at a defect that a current reflector antenna easily causes a phase error on a surface where an electromagnetic wave is emergent, to provide an antenna reflector phase correction film that can correct a surface emergent phase of a reflector.

A technical solution adopted by the disclosure to solve the technical problem is: an antenna reflector phase correction film, where the antenna reflector phase correction film includes a first substrate, a second substrate, and multiple artificial microstructures disposed between the first substrate and the second substrate, the artificial microstructures are wires made of electrically conductive materials, the first substrate and the second substrate are flexible substrates, and refractive index distribution of the antenna reflector phase correction film is rationally designed so that an electromagnetic wave, emergent after being reflected by an antenna reflector attached with the antenna reflector phase correction film, has a flat equiphase surface.

Further, the equiphase surface obtained after the electromagnetic wave is directly reflected by the antenna reflector is defined as an original equiphase surface, a perpendicular distance from any point on the original equiphase surface to an ideal equiphase surface is defined as $D_m$, an emergent phase passed through by the electromagnetic wave in the distance $D_m$ is $X_m$, and then, $$X_m = \pm \frac{\omega D_m}{c};$$

where when a point on the original equiphase surface is located on the left side of the ideal equiphase surface, $X_m$ takes a positive value;

when a point on the original equiphase surface is located on the right side of the ideal equiphase surface, $X_m$ takes a negative value;

a size of a point on the equiphase surface is the same as that of a single artificial microstructure;

wherein, ω is an angular frequency of an electromagnetic wave; and c is speed of light.

Further, a refractive index of a part of the antenna reflector phase correction film corresponding to that $X_m$ is zero is a constant value $n_1$, a refractive index of a part of the antenna reflector phase correction film corresponding to that $X_m$ is not zero is $n_m$, and $$n_m = n_1 - \frac{X_m \times c}{\omega \times 2d};$$

where

ω is an angular frequency of an electromagnetic wave;

d is thickness of the antenna reflector phase correction film; and c is speed of light.

Further, the artificial microstructure has a first main line and a second main line that intersect, the first main line and the second main line bisect each other perpendicularly, and the first main line and the second main line are of equal length.

Further, the artificial microstructure is an axial symmetry structure that takes the first main line and the second main line respectively as an axis of symmetry.

Further, both ends of the first main line are connected with two first knuckle lines, the two first knuckle lines have a 90-degree corner, and the first main line coincides with an angle bisector of the corner of the first knuckle line.

Further, both ends of the second main line are connected with two second knuckle lines, the two second knuckle lines have a 90-degree corner, and the second main line coincides with an angle bisector of the corner of the second knuckle line.

Further, the first knuckle lines have first corner points, the both ends of the first main line are respectively connected with two first corner points of the two first knuckle lines, and the first knuckle lines have a first horizontal right-angle side and a first vertical right-angle side of equal length.

Further, the second knuckle lines have second corner points, the both ends of the second main line are respectively connected with two second corner points of the two second knuckle lines, and the second knuckle lines have a second horizontal right-angle side and a second vertical right-angle side of equal length.

Further, both ends of the first main line are connected with midpoints of two first branch lines of equal length, and both ends of the second main line are connected with midpoints of two second branch lines of equal length.

Further, each of the two ends of the first branch line has two first broken lines protruding after being bent inwardly, and each of the two ends of the second branch line has two second broken lines protruding after being bent inwardly.

Further, the artificial microstructure has a first main line and a second main line that intersect, both ends of the first main line are connected with two first knuckle lines, both ends of the second main line are connected with two second knuckle lines, the first main line and the second main line bisect each other perpendicularly, the first main line and the second main line are of equal length, the first knuckle lines have first corner points, the both ends of the first main line are respectively connected with two first corner points of the two first knuckle lines, the second knuckle lines have second corner points, and the both ends of the second main line are respectively connected with two second corner points of the two second knuckle lines.

Further, the two first knuckle lines have a 90-degree corner, the first main line coincides with an angle bisector of the corner of the first knuckle line, the two second knuckle lines have a 90-degree corner, the second main line coincides with an angle bisector of the corner of the second broken line, the first knuckle lines have a first horizontal right-angle side and a first vertical right-angle side of equal length, the second knuckle lines have a second horizontal right-angle side and a second vertical right-angle side of equal length, and the first knuckle lines and the second knuckle lines are of a same size.

Further, each part of the artificial microstructure has a same thickness, the thickness is $H_2$, and 0.01 mm$\leq H_2 \leq$0.5 mm;

each part of the artificial microstructure has a same line width, the line width is W, and 0.08 mm$\leq$W$\leq$0.3 mm;

a distance between the first knuckle line and its adjacent second knuckle line is $d_1$, and 0.08 mm$\leq d_1 \leq$1 mm;

a gap between two adjacent artificial microstructures is WL, and 0.08 mm$\leq$WL$\leq$1 mm; and a distance between two adjacent artificial microstructures is L, and 1 mm$\leq$L$\leq$30 mm.

Further, the first substrate and the second substrate have a same thickness, the thickness is $H_1$, and 0.1 mm$\leq H_1 \leq$1 mm.

Further, the first substrate and the second substrate have a same permittivity, and the permittivity has a value range of 2.5-2.8.

Further, the first substrate and the second substrate are made of ceramics materials, F4B composite materials, FR-4 composite materials, or polystyrene.

Further, the artificial microstructure is made of a copper line or a silver line, and the multiple artificial microstructures on the first substrate are obtained by means of etching, electroplating, drilling, photolithography, electronic engraving, or ion engraving.

Further, the flexible substrate is polyimide or mylar.

Further, the antenna reflector phase correction film has a gap.

Further, the antenna reflector phase correction film further includes a protective layer and/or edge sealing.

Further, the antenna reflector phase correction film partially or wholly covers a surface of an object to be attached.

Further, the antenna reflector phase correction film is connected to a surface of an object to be attached by means of one or multiple types of manners of bonding, fastener fastening, fastening, and clamping connection.

According to the disclosure, the antenna reflector phase correction film has specific refractive index distribution internally, so that a surface emergent phase of a reflector can be corrected after attaching onto a surface of a conventional reflector, a phase error caused due to installation or processing is improved, a complete flat emergent equiphase is obtained, and then a far-field performance (such as a higher gain) is improved.

In addition, the disclosure further provides a reflector antenna attached with the antenna reflector phase correction film.

BRIEF DESCRIPTION OF DRAWINGS

The following further details the disclosure with reference to accompanying drawings and embodiments. In the accompanying drawings.

DESCRIPTION OF EMBODIMENTS

Figure 1:
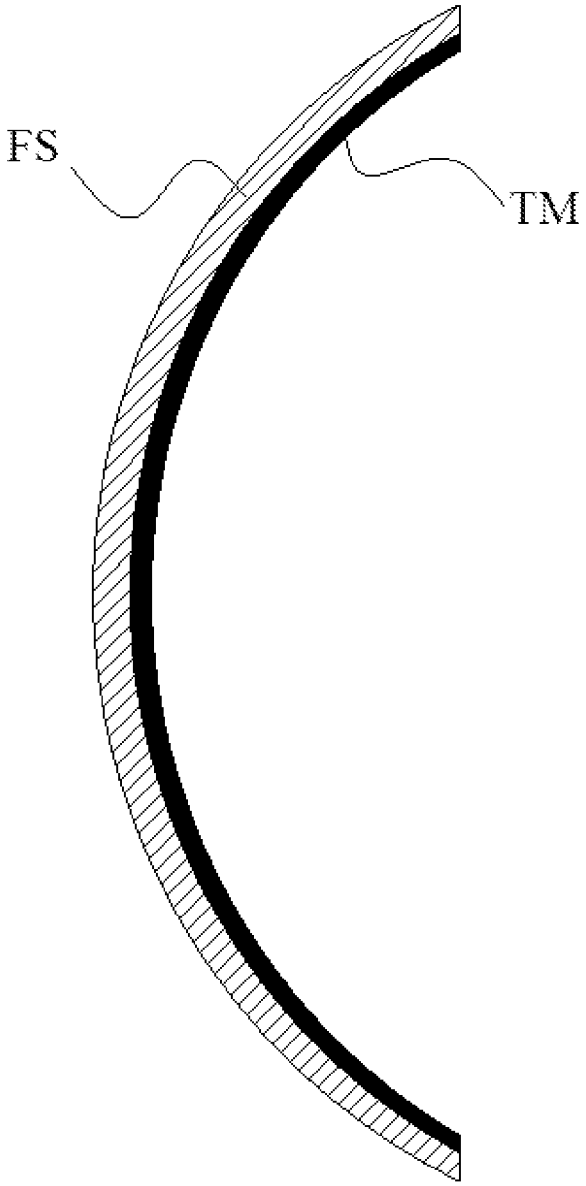
FIG. 1 is a reflector antenna attached with an antenna reflector phase correction film according to the disclosure.

According to the disclosure, an antenna reflector phase correction film includes a first substrate, a second substrate, and at least one conductive geometric structure disposed between the first substrate and the second substrate, the first substrate and the second substrate are flexible substrates, and an electromagnetic wave, emergent after being reflected by an antenna reflector attached with the antenna reflector phase correction film, has an equiphase surface.

The conductive geometric structure is preferably an artificial microstructure. The artificial microstructure preferably has a first main line and a second main line that intersect, two first auxiliary lines that are respectively disposed on both ends of the first main line in a symmetrical manner, and two second auxiliary lines that are respectively disposed on both ends of the second main line in a symmetrical manner. Further preferably, a first auxiliary line structure and a second auxiliary line structure have a same size and structure. In addition, preferably, the first main line and the second main line have a same size and structure, and the first main line and the second main line bisect each other perpendicularly in their midpoints. Also preferably, the artificial microstructure is an axial symmetry structure relative to both the first main line and the second main line.

According to the disclosure, the antenna reflector phase correction film has specific refractive index distribution internally because of having a conductive geometric structure, so that a surface emergent phase of a reflector can be corrected after attaching onto a surface of a conventional reflector, a phase error caused due to installation or processing is improved, a complete flat emergent equiphase is obtained, and then a far-field performance (such as a higher gain) is improved.

When the antenna reflector phase correction film is flattened, preferably, its edge has a certain gap, so that when a coating surface of a to-be-attached object such as an antenna reflector is a curved surface or is in an irregular shape, the to-be-attached object such as the antenna reflector can exactly match a surface of the antenna reflector by splicing together the gap.

In addition, the antenna reflector phase correction film further includes a protective layer and/or edge sealing. The protective layer and/or edge sealing that is configured is beneficial for the antenna reflector phase correction film to withstand external environmental pressure.

In addition, the antenna reflector phase correction film further includes at least one third substrate disposed on one side of the second substrate, at least one conductive geometric structure disposed between the second substrate and the third substrate, and at least one conductive geometric structure disposed between each two adjacent third substrates. That is to say, a conductive geometric structure, represented by an artificial microstructure, of the antenna reflector phase correction film can be of multiple layers.

The disclosure further provides a reflector antenna, where an antenna reflector of the reflector antenna is attached with the antenna reflector phase correction film according to the disclosure.

A surface of an object to be attached, for example an entire surface of an antenna reflector of a reflector antenna, can be completely attached with an antenna reflector phase correction film. However, more than two layers of antenna reflector phase correction films may be attached to a partial or entire surface of an antenna reflector of a reflector antenna.

Further, the antenna reflector phase correction film is connected to a surface of an object to be attached by means of one or multiple types of manners of bonding, fastener fastening, fastening, and clamping connection. A bonding manner may be an adhesive, a fastener may be a bolt, screw, or dowel, or the like, clamping connection may be a gap rear-inversion manner, and fastening may involve implementation through plastics or metal deformation.

The following details preferable embodiments of the disclosure with reference to FIG. 1 to FIG. 8.

Figure 2:
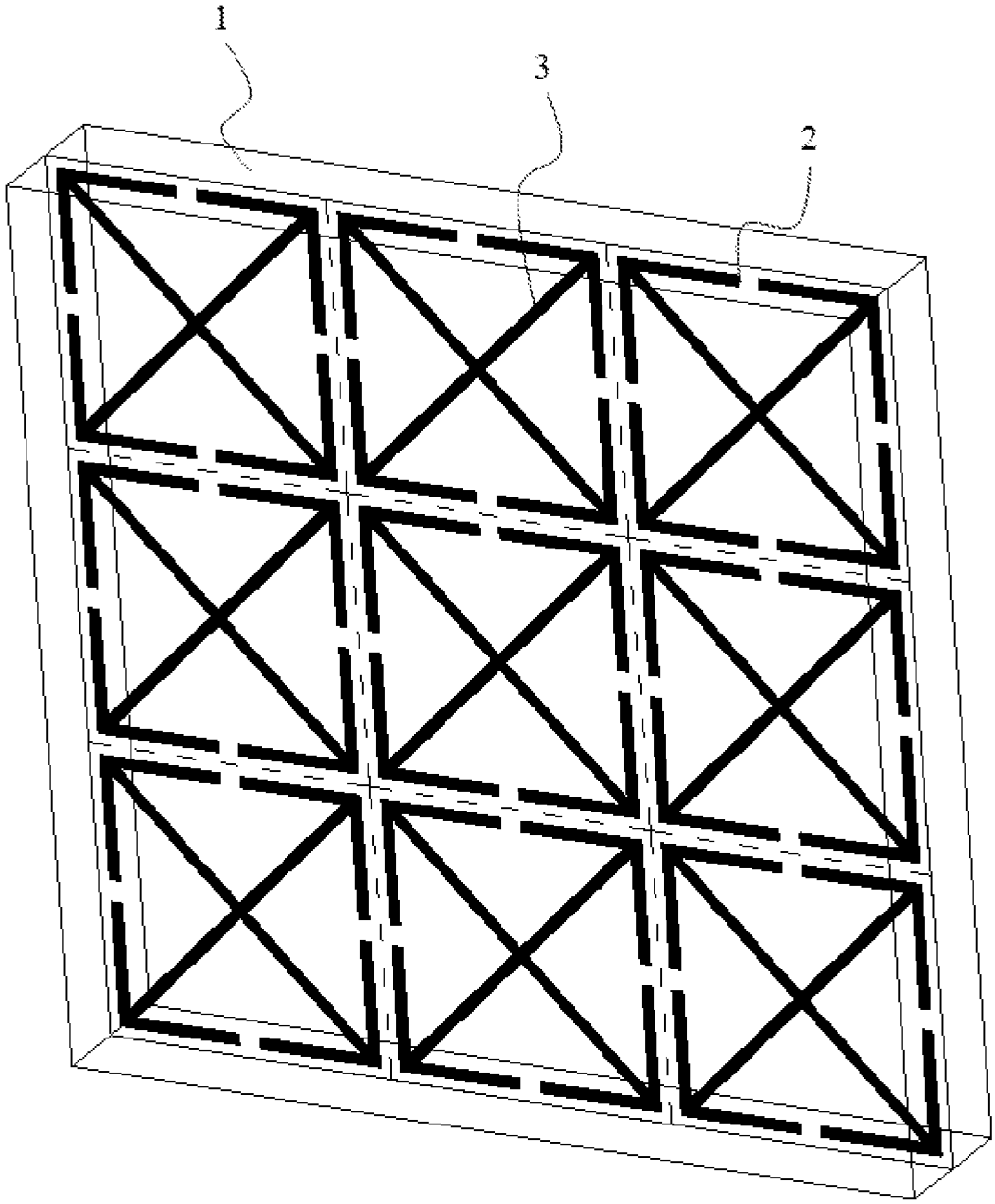
FIG. 2 is a schematic structural diagram (perspective) of an antenna reflector phase correction film according to the disclosure.

As shown in FIG. 1 to FIG. 2, the antenna reflector phase correction film TM according to the embodiment of the disclosure includes a first substrate 1, a second substrate 2, and multiple artificial microstructures 3 disposed between the first substrate 1 and the second substrate 2, the artificial microstructures 3 are wires made of electrically conductive materials, the first substrate 1 and the second substrate 2 are flexible substrates, and refractive index distribution of the antenna reflector phase correction film TM is rationally designed so that an electromagnetic wave, emergent after being reflected by an antenna reflector FS attached with the antenna reflector phase correction film TM, has a flat equiphase surface.

The flexible substrate according to the embodiment of the disclosure is namely conventional polyimide or mylar used by a flexible printed circuit board (FPC). The artificial microstructure may be a metal microstructure, and a printing manner of the artificial microstructure can be similar to conventional FPC technique. Only for a metal circuit, the artificial microstructure of the disclosure is designed according to refractive index distribution.

The antenna reflector FS shown in FIG. 1 is a parabolic reflector. Since the antenna reflector phase correction film TM according to the embodiment of the disclosure is flexible, the antenna reflector phase correction film TM can optimally fit a parabolic reflector. Certainly, a manufactured antenna reflector phase correction film TM is planar, and can be tailored appropriately to better attach to a surface of the antenna reflector FS.

Figure 4:
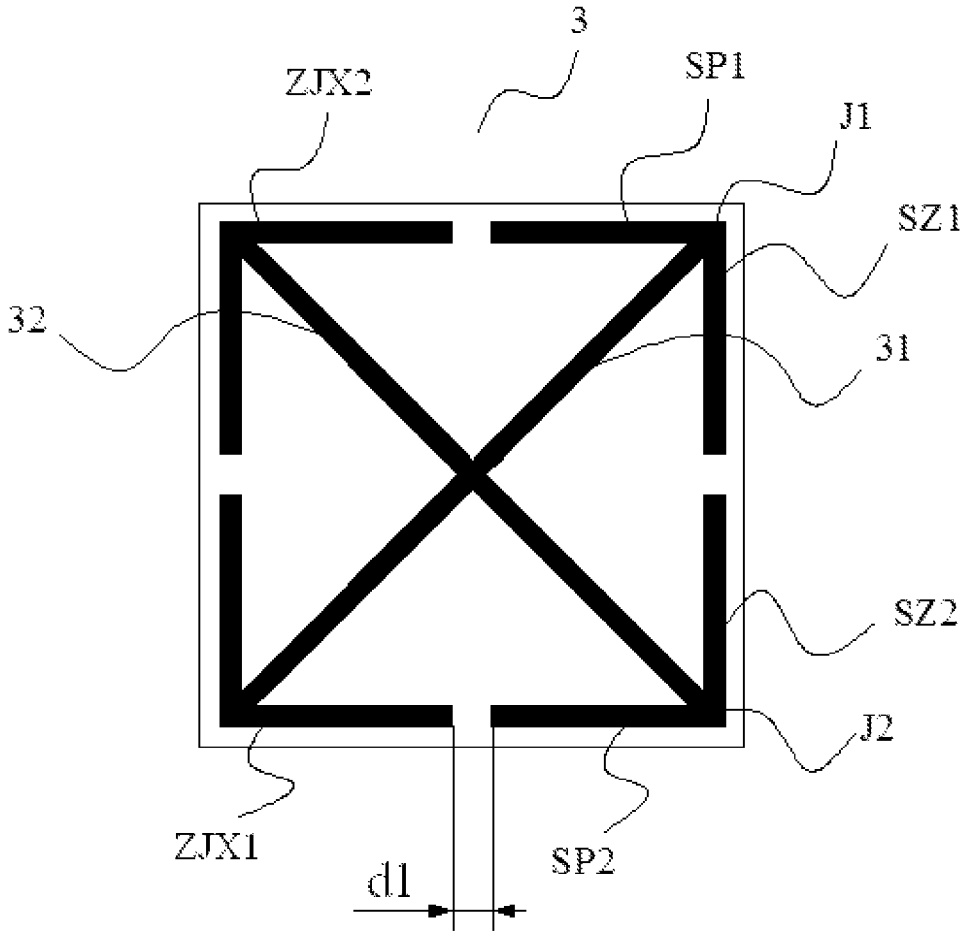
FIG. 4 is a schematic structural diagram of a single artificial microstructure.

An artificial microstructure according to the embodiment of the disclosure may be the artificial microstructure shown in FIG. 4. As shown in FIG. 4, the artificial microstructure 3 has a first main line 31 and a second main line 32 that bisect each other perpendicularly, the first main line 31 and the second main line 32 are of equal length, the first knuckle line ZJX1 has a first corner point J1, both ends of the first main line 31 are respectively connected with two first corner points J1 of the two first knuckle lines ZJX1, and the second knuckle line ZJX2 has a second corner point J2, both ends of the second main line 32 are respectively connected with two second corner points J2 of the two second knuckle lines ZJX2. The two first knuckle lines ZJX1 have a 90-degree corner, the first main line 31 coincides with an angle bisector of the corner of the first knuckle line ZJX1, the two second knuckle lines ZJX2 have a 90-degree corner, the second main line 32 coincides with an angle bisector of the corner of the second knuckle line ZJX2, the first knuckle lines ZJX1 have a first horizontal right-angle side SP1 and a first vertical right-angle side SZ1 of equal length, an angle between the first horizontal right-angle side SP1 and the first vertical right-angle side SZ1 is a corner of the first knuckle line ZJX1, the second knuckle lines ZJX2 have a second horizontal right-angle side SP2 and a second vertical right-angle side SZ2 of equal length, and an angle between the second horizontal right-angle side SP2 and the second vertical right-angle side SZ2 is a corner of the second knuckle line ZJX2. In addition, the first knuckle line ZJX1 and the second knuckle line ZJX2 are of a same size.

Figure 5:
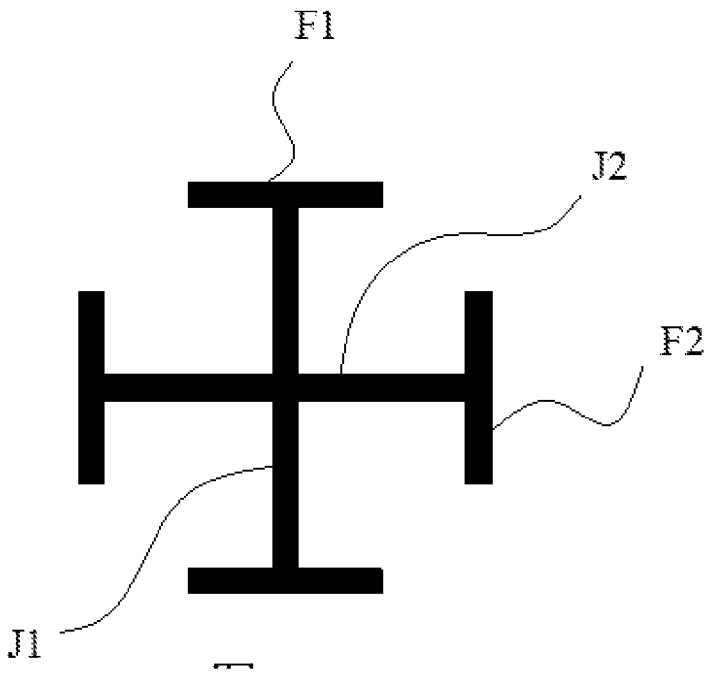
FIG. 5 is a schematic structural diagram of an artificial microstructure according to another manner of the disclosure.
Figure 6:
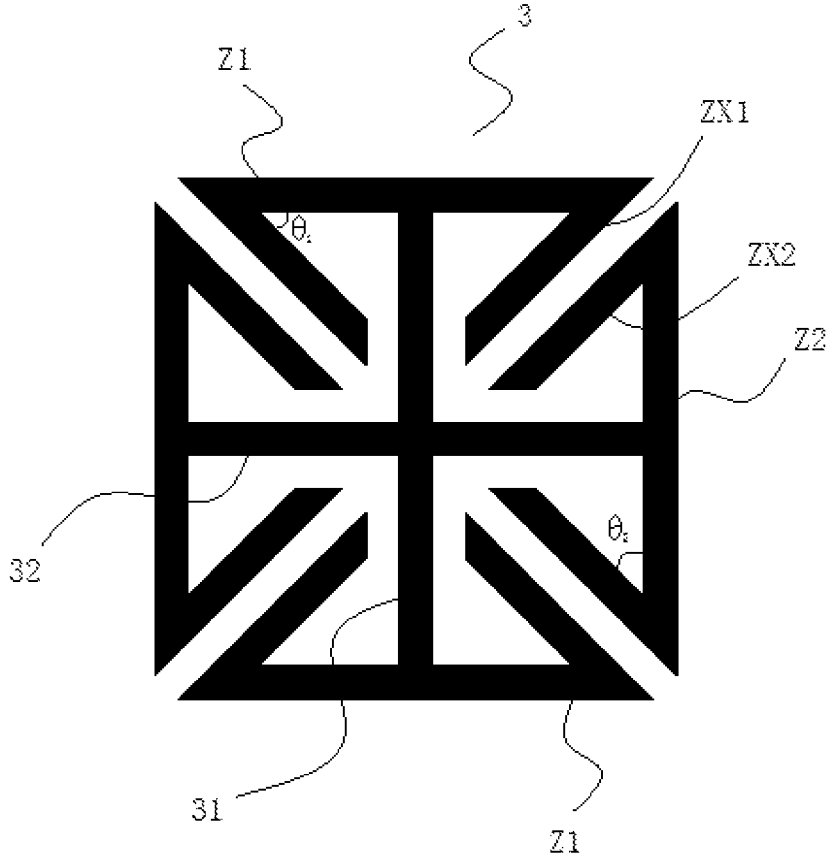
FIG. 6 is a schematic structural diagram of an artificial microstructure according to another manner of the disclosure.

Certainly, the artificial microstructure in the disclosure may be an artificial microstructure in the form shown in FIG. 5 and FIG. 6.

FIG. 5 shows a planar snowflake-like artificial microstructure. The planar snowflake-like artificial microstructure has a first metal wire J1 and a second metal wire J2 that bisect each other perpendicularly, the first metal wire J1 and the second metal wire J2 are of equal length, two ends of the first metal wire J1 are connected with two first metal branches F1 of equal length, the two ends of the first metal wire J1 are connected to midpoints of the two first metal branches F1, two ends of the second metal wire J2 are connected with two second metal branches F2 of equal length, the two ends of the second metal wire J2 are connected to midpoints of the two second metal branches F2, and the first metal branch F1 and the second metal branch F2 are of equal length.

FIG. 6 is a deformed structure of that shown in FIG. 5. The artificial microstructure 3 has a first main line 31 and a second main line 32 that bisect each other perpendicularly, the first main line 31 and the second main line 32 are of equal length, both ends of the first main line 31 are connected with two first branch lines Z1 of equal length, both ends of the first main line 31 are connected to midpoints of the two first branch lines Z1, both ends of the second main line 32 are connected with two second branch lines Z2 of equal length, both ends of the second main line 32 are connected to midpoints of the two second branch lines Z2, the first branch line Z1 and the second branch line Z2 are of equal length, each of the two ends of the first branch line Z1 has two first broken lines ZX1 protruding after being bent inwardly, and each of the two ends of the second branch line Z2 has two second broken lines ZX2 protruding after being bent inwardly. In this embodiment, an angle between the first broken line ZX1 and the first branch line Z1 is $\theta_1$, and an angle between the second broken line ZX2 and the second branch line Z2 is $\theta_2$, and $$\theta_1=\theta_2;\theta_1\leq 45^\circ$$

Preferably, the angle $\theta_1$ between the first broken line ZX1 and the first branch line Z1 and the angle $\theta_2$ between the second broken line ZX2 and the second branch line Z2 are both 45 degrees. That is, two adjacent first broken line ZX1 and second broken line ZX2 are parallel.

FIG. 2 is a perspective view. Assuming that a first substrate 1 and a second substrate 2 are transparent, and an artificial microstructure 3 is not transparent.

Figure 3:
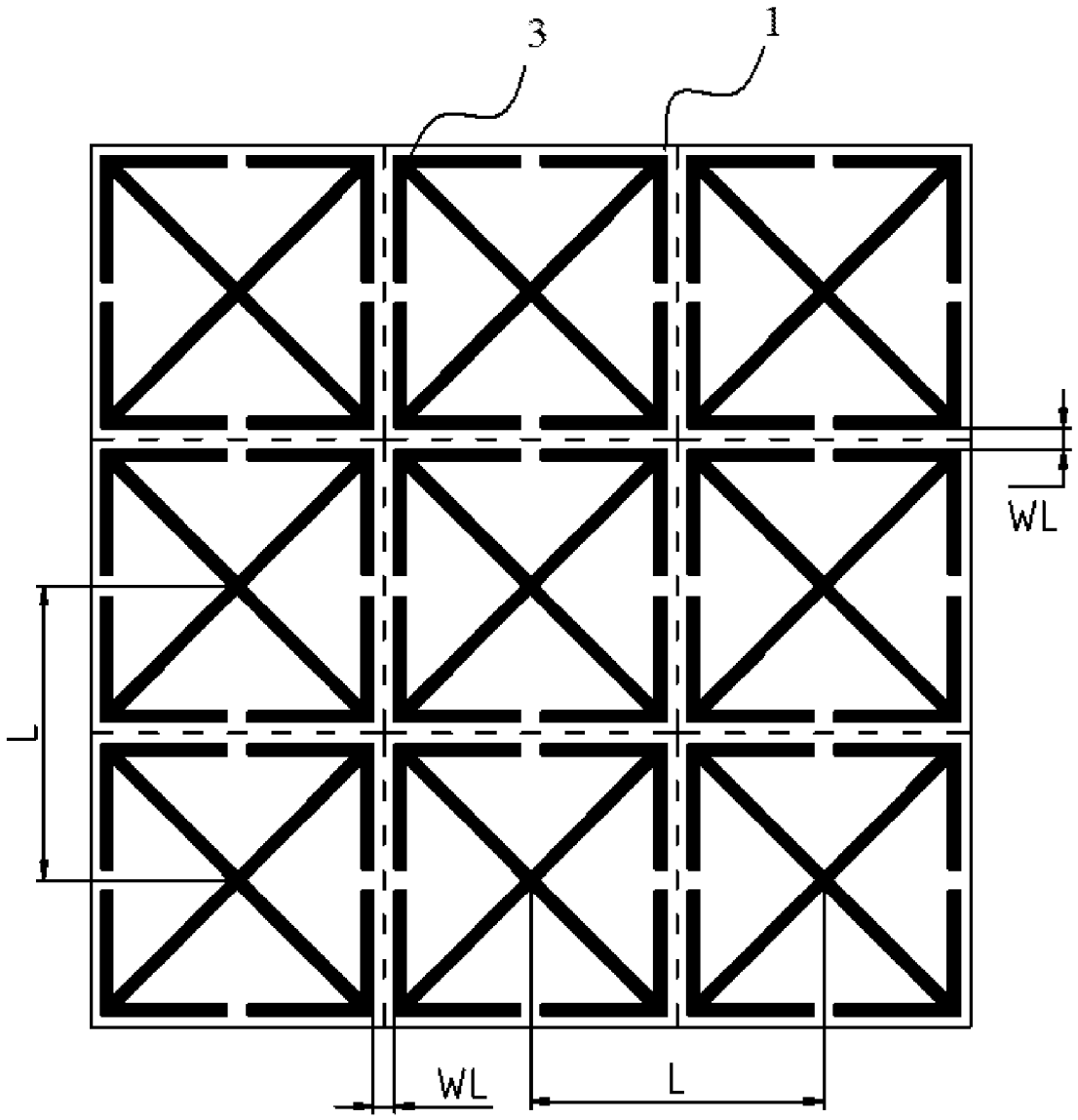
FIG. 3 is a front view of the antenna reflector phase correction film shown in FIG. 2 after removal of a second substrate.

In this embodiment, as shown in FIG. 3 and FIG. 4, each part of the artificial microstructure 3 has a same thickness, the thickness is $H_2$, and 0.01 mm$\leq H_2\leq$0.5 mm;

each part of the artificial microstructure has a same line width, the line width is W, and 0.08 mm$\leq$W$\leq$0.3 mm;

a distance between the first knuckle line ZJX1 and its adjacent second knuckle line ZJX2 is $d_1$, and 0.08 mm$\leq d_1\leq$1 mm;

a gap between two adjacent artificial microstructures 3 is WL, and 0.08 mm$\leq$WL$\leq$1 mm; and as shown in FIG. 3, WL indicates a distance from a first corner point J1 of one of artificial microstructures 3 to a second corner point J2, adjacent to the first corner point J1, of another artificial microstructure.

A distance between two adjacent artificial microstructures is L, and 1 mm$\leq$L$\leq$30 mm; as shown in FIG. 3, L is a distance between midpoints of two adjacent microstructures 3, where a midpoint herein refers to an intersection point between a first main line 31 and a second main line 32. Length of L is related to an incident electromagnetic wave. Usually, the length of L is less than a wavelength of the incident electromagnetic wave, for example, L may be ⅕ or 1/10 of the incident electromagnetic wave, thereby generating a continuous response to the incident electromagnetic wave.

In the embodiment of the disclosure, the artificial microstructures 3 are wires made of electrically conductive materials. For example, copper wires, silver wires, and other metallic wires, the artificial microstructures 3 made of metallic materials can be obtained by means of etching, electroplating, drilling, photolithography, electronic engraving, or ion engraving. For example, the first substrate 1 can be coated with a copper film or silver film with a certain thickness, partial copper films or silver films except for multiple artificial microstructures 3 are removed by means of etching (dissolution and corrosion by using a chemical solution), and then multiple artificial microstructures 3 attached on the first substrate 1 can be obtained.

In addition, the artificial microstructures 3 may also be made from non-metallic conductive materials, such as an indium tin oxide, a carbon nanotube, or a graphite.

In the embodiment of the disclosure, the first substrate 1 and the second substrate 2 have a same thickness, the thickness is $H_1$, and 0.1 mm$\leq H_1\leq$1 mm. In addition, the first substrate 1 and the second substrate 2 have a same permittivity, and the permittivity has a value range of 2.5-2.8.

In the embodiment of the disclosure, the first substrate 1 and the second substrate 2 can be made of any dielectric material, such as, a ceramic material, a polymer material, a ferro-electric material, a ferrite material, or a ferro-magnetic material. A polymer material, for example, can be F4B composite materials, FR-4 composite materials, polystyrene (PS), or the like.

In the embodiment of the disclosure, simulation is performed by using an antenna reflector phase correction film having the following parameter, and simulation software is CST;

The first substrate 1 and the second substrate 2 are 1 mm in thickness; and the first substrate 1 and the second substrate 2 are a PS plastic plate with a permittivity of 2.7, and loss tangent is 0.0002.

A distance L between two adjacent artificial microstructures is 2.7 mm;

a thickness H2 of the artificial microstructure 3 is 0.018 mm;

a line width W of the artificial microstructure 3 is 0.14 mm;

a distance $d_1$ between the first knuckle line Z1 and the second knuckle line Z2 is 0.14 mm; and a gap WL between two adjacent artificial microstructures is 0.14 mm.

Figure 7:
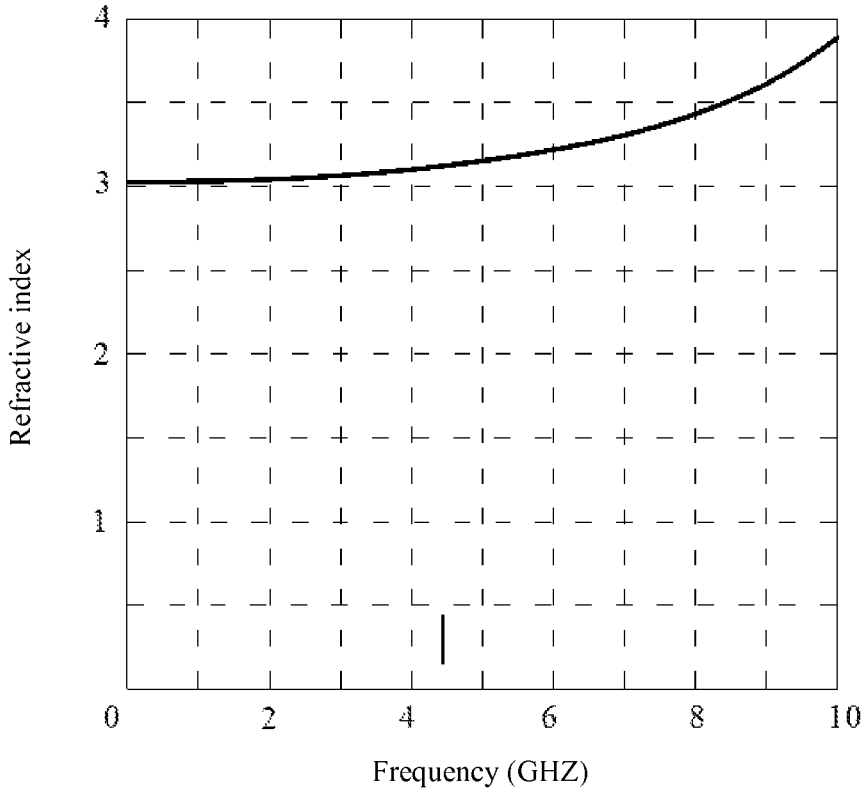
FIG. 7 is a schematic diagram of an electromagnetic response simulation curve of a refractive index of the antenna reflector phase correction film that is shown in FIG. 2 and is relative to a frequency.

Simulation is performed on an antenna reflector phase correction film TM having the foregoing parameters, that is, refractive indexes of the antenna reflector phase correction film at different frequencies are tested, and an electromagnetic response curve of refractive indexes relative to the frequencies is obtained, which is shown in FIG. 7. It can be seen from FIG. 7 that, the antenna reflector phase correction film TM has an optimal low dispersion performance (namely, stable refractive index change) at a relative wide frequency band (0-10 GHZ). Meanwhile, the antenna reflector phase correction film TM also has a low electromagnetic loss, and does not affect radiation of an original reflector antenna.

The antenna reflector phase correction film according to the disclosure is designed based on demands, for example, can be designed by means of the following method.

Figure 8:
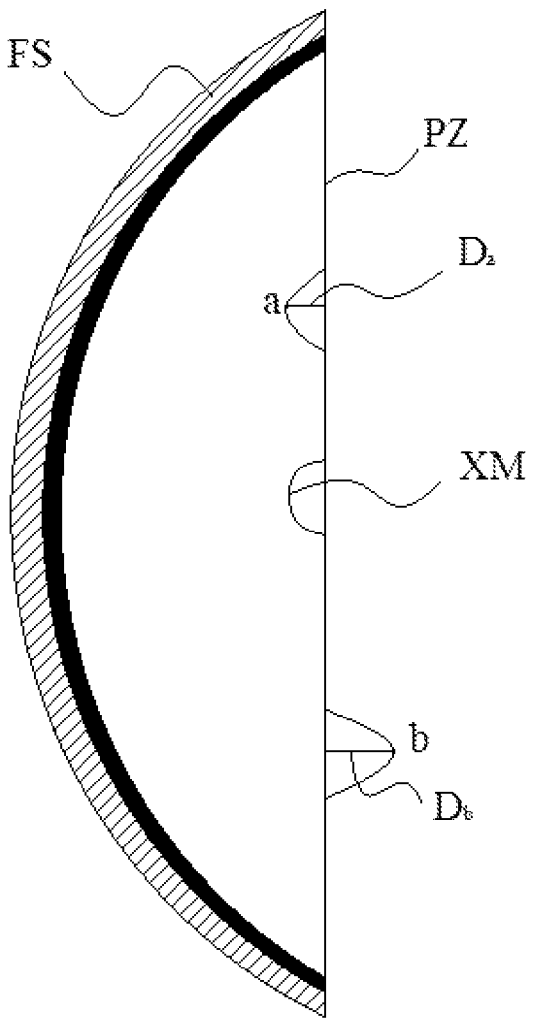
FIG. 8 is a schematic diagram of a design method of an antenna reflector phase correction film according to the disclosure.

As shown in FIG. 8, the equiphase surface obtained after the electromagnetic wave is directly reflected by an antenna reflector FS is first defined as an original equiphase surface XM, a perpendicular distance from any point (for example, point a and point b in the figure) on the original equiphase surface XM to an ideal equiphase surface PZ is defined as $D_m$, an emergent phase passed through by the electromagnetic wave in the distance $D_m$ is $X_m$, and then, $$X_m = \pm\frac{\omega D_m}{c}; \tag{1}$$

wherein,

ω is an angular frequency of an electromagnetic wave; and c is speed of light.

when a point on the original equiphase surface is located on the left side of the ideal equiphase surface PZ, $X_m$ takes a positive value;

when a point on the original equiphase surface is located on the right side of the ideal equiphase surface PZ, $X_m$ takes a negative value;

for example, point a in the figure, when the point a is located on the left side of the ideal equiphase surface PZ, a phase of the point passing in a distance $D_a$ is $X_a$; where $$X_a = \frac{\omega D_a}{c};$$

for another example, point b in the figure, the point a is located on the right side of the ideal equiphase surface PZ, a phase of the point passing in a distance $D_b$ is $X_b$; where $$X_b = -\frac{\omega D_b}{c};$$

In the embodiment of the disclosure, the ideal equiphase surface PZ is namely the foregoing flat equiphase. A size of a point on the equiphase surface is the same as that of a single artificial microstructure.

Further, a refractive index of a part of the antenna reflector phase correction film corresponding to that $X_m$ is zero is a constant value $n_1$, namely $X_0=0$; a refractive index of a part of the antenna reflector phase correction film corresponding to that $X_m$ is not zero is $X_m$, and $$n_m = n_1 - \frac{X_m \times c}{\omega \times 2d}; \quad (2)$$

wherein,

ω is an angular frequency of an electromagnetic wave;

d is thickness of the antenna reflector phase correction film; and c is speed of light.

When a point on the original equiphase surface is located on the left side of the ideal equiphase surface PZ, $X_m$ takes a positive value, formula (1) is put into formula (2), formula (2) is simplified, and then the following is obtained:

$$n_m = n_1 - \frac{D_m}{2d}; \quad (3)$$

That is, a refractive index of a projection point of a point on the left side of an original equiphase surface on an antenna reflector phase correction film TM is less than $n_1$. In addition, a design value of a refractive index of the point is only related to a perpendicular distance $D_m$ from any point on the original equiphase surface to an ideal equiphase surface and thickness d of the antenna reflector phase correction film. An original equiphase surface can be obtained by means of laser scanning.

When a point on the original equiphase surface is located on the right side of the ideal equiphase surface PZ, $X_m$ takes a negative value, formula (1) is put into formula (2), formula (2) is simplified, and then the following is obtained:

$$n_m = n_1 + \frac{D_m}{2d}; \quad (4)$$

That is, a refractive index of a projection point of a point on the left side of an original equiphase surface on an antenna reflector phase correction film TM is greater than $n_1$.

Taking point a and point b as an example, in terms of point a, the following is obtained:

$$n_a = n_1 - \frac{D_a}{2d};$$

in terms of point b, the following is obtained:

$$n_b = n_1 + \frac{D_b}{2d};$$

Therefore, after $D_a$ and $D_b$ are known (obtained by means of laser scanning), and values of $n_1$ and d are determined, $n_a$ and $n_b$ can be designed, so that two points obtained after correction of point a and point b are located on the ideal equiphase surface PZ. By analogy, an entire original equiphase surface can be corrected, so that a final equiphase surface coincides with the ideal equiphase surface PZ, that is, phase correction of a specific reflector antenna is completed.

In addition, the disclosure further provides a reflector antenna attached with the antenna reflector phase correction film TM. The antenna further includes a feed source, and the feed source is disposed on a focus of the reflector antenna.

The foregoing describes the embodiments of the disclosure with reference to the accompanying drawings. However, the disclosure is not limited to the foregoing specific implementation manners. The foregoing specific implementation manners are only for exemplary description and are not restrictive. Under enlightenment of the disclosure, a person of ordinary skill in the art may make various equivalent modifications or replacements without departing from the spirit of the disclosure and the protection scope of the claims, and these modifications or replacements should fall within the protection scope of the disclosure.

What is claimed is:

1. An antenna reflector phase correction film, comprising: a first substrate, a second substrate, and at least one conductive geometric structure disposed between the first substrate and the second substrate, and an electromagnetic wave, emergent after being reflected by an antenna reflector attached with the antenna reflector phase correction film, has an equiphase surface;

wherein when the antenna reflector phase correction film is flattened, preferably, its edge has a certain gap, so that when a coating surface of a to-be-attached object such as an antenna reflector is a curved surface or is in an irregular shape, the to-be-attached object such as the antenna reflector can exactly match a surface of the antenna reflector by splicing together the gap;

the equiphase surface obtained after the electromagnetic wave is directly reflected by the antenna reflector is defined as an original equiphase surface; a perpendicular distance from any point on the original equiphase surface to an ideal equiphase surface is defined as $D_m$, an emergent phase passed through by the electromagnetic wave in the distance $D_m$ is $X_m$, and then, $$X_m = \pm \frac{\omega D_m}{c};$$

wherein, when a point on the original equiphase surface is located on the left side of the ideal equiphase surface PZ, $X_m$ takes a positive value:

when a point on the original equiphase surface is located on the right side of the ideal equiphase surface PZ, $X_m$ takes a negative value:

a size of a point on the equiphase surface is the same as that of a single artificial microstructure:

wherein, ω is an angular frequency of an electromagnetic wave; and c is speed of light;

wherein the ideal equiphase surface PZ is namely the foregoing flat equiphase, a size of a point on the equiphase surface is the same as that of a single artificial microstructure.

2. The antenna reflector phase correction film according to claim 1, wherein the conductive geometric structure is an artificial microstructure, the artificial microstructure is designed according to refractive index distribution.

3. An antenna reflector phase correction film, comprising: a first substrate, a second substrate, and multiple artificial microstructures disposed between the first substrate and the second substrate, the artificial microstructures are wires made of electrically conductive materials, the first substrate and the second substrate are flexible substrates, and refractive index distribution of the antenna reflector phase correction film is rationally designed so that an electromagnetic wave, emergent after being reflected by an antenna reflector attached with the antenna reflector phase correction film, has a flat equiphase surface, wherein the flexible substrate is namely conventional polyimide or mylar used by a flexible printed circuit board (FPC).

4. The antenna reflector phase correction film according to claim 1, wherein a refractive index of a part of the antenna reflector phase correction film corresponding to that $X_m$ is zero is a constant value $n_1$, a refractive index of a part of the antenna reflector phase correction film corresponding to that $X_m$ is not zero m is $n_m$, and $$n_m = n_1 - \frac{X_m \times c}{\omega \times 2d};$$

wherein,

ω is an angular frequency of an electromagnetic wave;

d is thickness of the antenna reflector phase correction film; and c is speed of light.

5. The antenna reflector phase correction film according to claim 1, wherein the artificial microstructure has a first main line and a second main line that intersect, the first main line and the second main line bisect each other perpendicularly, and the first main line and the second main line are of equal length;

wherein both ends of the first main line are connected with two first knuckle lines; both ends of the second main line are connected with two second knuckle lines.

6. The antenna reflector phase correction film according to claim 5, wherein the artificial microstructure is an axial symmetry structure that takes the first main line and the second main line respectively as an axis of symmetry.

7. The antenna reflector phase correction film according to claim 5, wherein the two first knuckle lines have a 90-degree corner, and the first main line coincides with an angle bisector of the corner of the first knuckle line.

8. The antenna reflector phase correction film according to claim 7, wherein the two second knuckle lines have a 90-degree corner, and the second main line coincides with an angle bisector of the corner of the second knuckle line.

9. The antenna reflector phase correction film according to claim 8, wherein the first knuckle lines have first corner points, the both ends of the first main line are respectively connected with two first corner points of the two first knuckle lines, and the first knuckle lines have a first horizontal right-angle side and a first vertical right-angle side of equal length.

10. The antenna reflector phase correction film according to claim 9, wherein the second knuckle lines have second corner points, the both ends of the second main line are respectively connected with two second corner points of the two second knuckle lines, and the second knuckle lines have a second horizontal right-angle side and a second vertical right-angle side of equal length.

11. The antenna reflector phase correction film according to claim 10, wherein each part of the artificial microstructure has a same thickness, the thickness is $H_2$, and 0.01 mm≤$H_2$≤0.5 mm;

each part of the artificial microstructure has a same line width, the line width is W, and 0.08 mm≤W≤0.3 mm;

a distance between the first knuckle line and its adjacent second knuckle line is $d_1$, and 0.08 mm≤$d_1$≤1 mm;

a gap between two adjacent artificial microstructures is w-L, and 0.08 mm≤WL≤1 mm; and a distance between two adjacent artificial microstructures is L, and 1 mm≤L≤30 mm.

12. The antenna reflector phase correction film according to claim 10, wherein the first substrate and the second substrate have a same thickness, the thickness is $H_1$, and 0.1 mm≤$H_1$≤1 mm.

13. The antenna reflector phase correction film according to claim 3, wherein the artificial microstructure is made of a copper line or a silver line, and the multiple artificial microstructures on the first substrate are obtained by means of etching, electroplating, drilling, photolithography, electronic engraving, or ion engraving.

14. The antenna reflector phase correction film according to claim 3, wherein the antenna reflector phase correction film has a gap.

15. The antenna reflector phase correction film according to claim 3, wherein the antenna reflector phase correction film further comprises a protective layer and/or edge sealing.

16. A reflector antenna, wherein an antenna reflector of the reflector antenna is attached with the antenna reflector phase correction film according to claim 3.

17. The antenna reflector phase correction film according to claim 1, wherein wherein, a design value of a refractive index of the point is only related to a perpendicular distance $D_m$ from any point on the original equiphase surface to an ideal equiphase surface and thickness d of the antenna reflector phase correction film;

$$n_m = n_1 \pm \frac{D_m}{2d};$$

wherein, when a point on the original equiphase surface is located on the left side of the ideal equiphase surface PZ, $X_m$ takes a positive value;

when a point on the original equiphase surface is located on the right side of the ideal equiphase surface PZ, $X_m$ takes a negative value;

a refractive index of a projection point of a point on the left side of an original equiphase surface on an antenna reflector phase correction film TM is greater than $n_1$;

an entire original equiphase surface can be corrected, so that a final equiphase surface coincides with the ideal equiphase surface PZ, that is, phase correction of a specific reflector antenna is completed.

18. The antenna reflector phase correction film according to claim 4, wherein wherein, a design value of a refractive index of the point is only related to a perpendicular distance $D_m$ from any point on the original equiphase surface to an ideal equiphase surface and thickness d of the antenna reflector phase correction film;

$$n_m = n_1 \pm \frac{D_m}{2d};$$

wherein when a point on the original equiphase surface is located on the left side of the ideal equiphase surface PZ, $X_m$ takes a positive value;

when a point on the original equiphase surface is located on the right side of the ideal equiphase surface PZ, $X_m$ takes a negative value;

a refractive index of a projection point of a point on the left side of an original equiphase surface on an antenna reflector phase correction film TM is greater than $n_1$;

an entire original equiphase surface can be corrected, so that a final equiphase surface coincides with the ideal equiphase surface PZ, that is, phase correction of a specific reflector antenna is completed.

* * * * *